US006503024B2

(12) United States Patent
Rupiper

(10) Patent No.: US 6,503,024 B2
(45) Date of Patent: Jan. 7, 2003

(54) CONCRETE FOUNDATION PIERHEAD AND METHOD OF LIFTING A FOUNDATION USING A JACK ASSEMBLY

(76) Inventor: Stan Rupiper, P.O. Box 465, Tahoma, CA (US) 96142

( * ) Notice: Subject to any disclaimer, the term of this patent is extended or adjusted under 35 U.S.C. 154(b) by 0 days.

(21) Appl. No.: 09/799,653

(22) Filed: Mar. 6, 2001

(65) Prior Publication Data

US 2001/0046415 A1 Nov. 29, 2001

Related U.S. Application Data

(60) Provisional application No. 60/187,082, filed on Mar. 6, 2000.

(51) Int. Cl.[7] ..... E02D 35/00

(52) U.S. Cl. ..... 405/230; 405/229; 405/235; 52/126.1

(58) Field of Search ..... 405/229, 230, 405/233, 235, 232, 231; 52/122.1, 126.1, 126.7

(56) References Cited

U.S. PATENT DOCUMENTS

| | | | | |
|---|---|---|---|---|
| 2,625,815 A | * | 1/1953 | Black | 52/126.1 |
| 4,438,607 A | * | 3/1984 | Nelson | 52/126.1 |
| 4,800,700 A | * | 1/1989 | May | 405/229 |
| 5,623,792 A | * | 4/1997 | Crumpacker | 52/103 |
| 6,142,710 A | * | 11/2000 | Holland et al. | 405/229 |

FOREIGN PATENT DOCUMENTS

| | | | |
|---|---|---|---|
| DE | 4005032 A | * | 8/1991 |
| GB | 2078823 A | * | 1/1982 |
| JP | 58-135230 A | * | 8/1983 |
| JP | 10-280427 A | * | 10/1998 |

* cited by examiner

*Primary Examiner*—Heather Shackelford
*Assistant Examiner*—John Kreck
(74) *Attorney, Agent, or Firm*—Edwin H. Crabtree; Ramon L. Pizarro; Donald W. Margolis

(57) ABSTRACT

A method and jacking assembly used for forming a concrete foundation pierhead. The pierhead is attached integrally to a foundation and/or floor system. A plurality of pierheads are used for leveling the foundation and floor system. Each of the pierheads include a jacking assembly which is used for jacking the pierhead on top of a vertical support member. The vertical support member may be a helix pipe pier, steel beams, posts, piers and the like. The pier pipe is installed into a ground surface and next to the foundation. The method steps include excavating a hole next to the foundation and installing the vertical support to a selected depth in the ground surface. The jacking assembly is then attached to the foundation and to a top of the vertical support. The pierhead is then poured around the jacking assembly and next to the foundation and floor system and allowed to cure. A space above the pierhead is provided which is sufficient to allow the jacking assembly to raise the pierhead on the vertical support and in turn raise the foundation and floor system to a level grade.

17 Claims, 2 Drawing Sheets

CONCRETE FOUNDATION PIERHEAD AND METHOD OF LIFTING A FOUNDATION USING A JACK ASSEMBLY

This application is based on a provisional patent application filed in the U.S. Patent and Trademark Office on Mar. 6, 2000 and having Ser. No. 60/187,082.

BACKGROUND OF THE INVENTION (a) Field of the Invention

This invention relates to an integral concrete foundation pierhead and jacking assembly and more particularly, but not by way of limitation, to a method of lifting a concrete foundation and/or floor system using the jacking assembly with the integral concrete foundation pierhead.

(b) Discussion of Prior Art

Heretofore, there have been a variety of foundation brackets, foundation jack assemblies and jack leveling systems for raising various types of foundation and concrete slabs. Also, the use of foundation brackets with steel pipe, concrete piers, helix steel piers and various other vertical support members installed into a ground surface adjacent to the foundation have been used in leveling foundation and floor systems.

None of the prior art foundation leveling systems provide the unique features, structure, method and advantages of the subject invention as described herein.

SUMMARY OF THE INVENTION

In view of the foregoing, it is a primary objective of the subject invention to provide a new and improved method of leveling and stabilizing a concrete foundation of a building structure and/or concrete floor system.

Another object of the new method is the use of a plurality of concrete pierheads which are integrated into the side of a concrete foundation which is corrosion protected. Also, an attached helix pipe pier or other type of vertical support member has fixity at each pierhead which provides a shorter "column" length of the vertical support member.

Still another object of the method is the total cost of labor and materials of an installation is less due to a decreased cost of fabricated steel components and ease of installation.

Yet another object of the invention is the use of anchor bolts which serve as tensioning bolts. The bolts allow drawing and fixing of the helix pipe pier to the existing concrete. This feature eliminates undesirable movement by tightening nuts behind an anchor plate and against a sleeve through which the helix pier is jacked. Also, the movement of the pierhead can be controlled with additional embedded anchor bolts and reinforcement.

A further object of the invention is the use of a jacking assembly having a lower jacking plate located to allow full jacking force against the reinforced concrete pierhead. The width of the pierhead can be adjusted to suit required loads. The concrete pierhead is placed and cured to a desired strength. Each pierhead may include plastic and metal fibers, high strength cement and other strength enhancing measures. The pierhead can also be constructed of other flowable high strength material similar to concrete. Also, the anchor bolts and the jacking assembly parts can be readily designed to suit special loads and conditions. The pierheads can be adjusted to a selected elevation individually, progressively or synchronized as required with mechanical and/or hydraulic jacks. The proper loads can be adjusted by torquing nuts above the jacking plate.

Still another object of the invention is, following the lifting and tightening of bolts on the jacking plates, an annular space between an exterior sleeve around the top of the helix pipe pier or other vertical support member can be grouted with an expansive grout thereby increasing the overall strength of the pier or support member.

Furthermore, another object of the invention is a top concrete pour of the pierhead can be made of low strength concrete or a cover plate can be used to allow for future adjustments if necessary. In this application, the grouting between a sleeve and the top of the pier will require a lubricated material. Also, fill beneath the jacking plate should initially be a foam material. Further, a number of these types of pierheads can be installed in new structures to allow for expected level adjustments.

Yet another object of the invention is each pierhead can be designed to fit small and large loads, adjusted to the size and shape of the member it is to be connected to. The pierheads can also be adjusted to suit vertical, battered, tieback (lateral load resistance), horizontal ties, seismic resistance, seismic damper connections and connected various types of building structures where concrete sections and the like require alignment, moving together or separation. The unique pierheads with jacking assemblies provide a means to adjust and fasten together large and small structures and align the structures vertically, horizontally and at various angles thereto.

The subject method is used for forming a plurality of concrete foundation pierheads. Each pierhead is attached to a structure foundation and/or floor system. The pierheads are used for leveling the foundation and the floor system. The pierhead includes a jack assembly, which is used for jacking the pierhead on top of a helix pipe pier or vertical support member. The pier is driven into the ground surface exterior to the foundation or interior through a floor system. The floor system may be a concrete slab. When the method is used to form an interior pierhead, the steps include first removing a portion of the floor framing system and driving a helix pipe pier or vertical support member next to the interior foundation or through properly located openings in slab construction. Next, holes are drilled into the side of the foundation for receiving ends of epoxied dowels, bolt fasteners or rebar. When using a helix pipe pier, a top elevation of the pier is set to allow at least one more inch of rise than the correct floor level indicates. A plastic or metal pier cap pipe, having at least 8 inches in length is inserted into the ground and around the top of the pier or around the vertical support member. The jacking plates with all-thread bolts, rebar and dowels are set in place. The lifting procedure is then started.

A first pour of high strength concrete, for example, 4000 psi, is poured and allowed to cure. The bottom of the newly formed pierhead is 1 inch below the expected lift of the slab or foundation with a minimum of 4 inches below the slab for nuts with bolts to be cut off and additional leveling if required. After the pierhead has cured, the jacking is commenced. For light loads, nuts are tightened downwardly on a top jack plate with the top jack plate resting on top of the helix pipe pier and the sleeve. For heavy loads, a hydraulic jack may be used for loading against the top jack plate. As pressure is applied to the top jack plate, the pierhead is raised upwardly to a selected grade and the concrete foundation and/or floor structure is leveled. At this time, the nuts are tightened on top of the jack plate. The hydraulic jack is removed and the top of the all-thread bolts are cut off. Finally, a second concrete pour, for example, of 2000 psi concrete is applied to the top of the pierhead and allowed to cure thus providing a pierhead cap. Also, other fabricated caps can be used equally well in covering the top of the pierhead.

These and other objects of the present invention will become apparent to those familiar with helix pipe piers and other vertical support members used in stabilizing structure foundations and floor systems when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate accompanying drawings complete preferred embodiments in the present invention according to the best modes presently devised for the practical application of the principles thereof, and in which.

DESCRIPTION OF THE PREFERRED EMBODIMENTS

Figure 1:
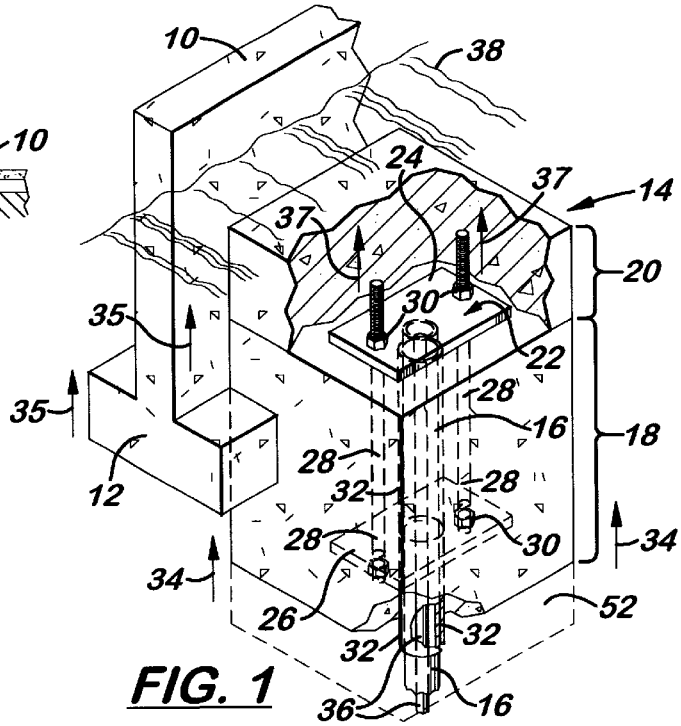
FIG. 1 is a perspective view of a portion of a building foundation and a concrete pierhead attached to a side of the foundation and secured to a top of a helix pipe pier. A portion of a second pour of concrete is cutaway to expose a jack assembly embedded inside the concrete pierhead.

In FIG. 1, a perspective view of a portion of a building foundation 10 with grade beam edge 12 is shown with the subject concrete pierhead, having general reference numeral 14. The pierhead 14 is shown attached to a side of the foundation 10 and secured to a top of a helix pipe pier 16. While the helix piper pier 16 is shown in the drawings, it should be kept in mind that the concrete pierhead can also be secured to other types of support structures driven or poured into the ground such as steel "I" and "H" beams, wooden posts and wooden and concrete piers and the like.

The concrete pierhead 14 is formed using a first pour 18 of high strength concrete and a second pour 20 of low strength concrete. A portion of a second pour 20 of the concrete is cutaway to expose a jacking assembly. The jacking assembly is shown having general reference numeral 22 and is embedded inside the concrete pierhead 14.

The jacking assembly 22 includes a top jacking plate 24, a bottom jacking plate 26, a pair of all-thread bolts 28 received through the two plates 24 and 26 with the top of the bolts 28 connected to a pair of threaded nuts 30. The top jacking plate 24 is designed to rest on top of the pier 16. Also, a plastic or metal sleeve 32 is received around a top portion of the pier 16. Also, for further stabilization, one or more elongated reinforcing bars 36 can be installed inside the shaft of the pier 16. In a lower portion of the pierhead 14, a portion of the pierhead has been cut away along with a lower portion of the sleeve 32 and pipe pier 16 to expose the elongated reinforcing bar 36 received therein.

Figure 3:
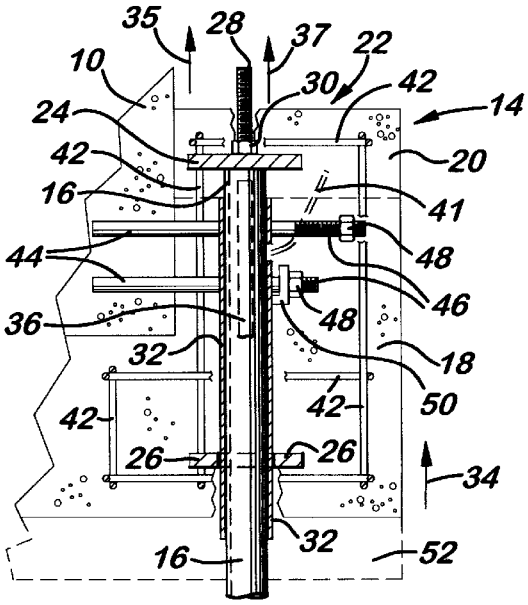
FIG. 3 is a side sectional view of the concrete pierhead and the top of the helix pipe pier after the foundation and existing slab have been leveled to a selected grade.
Figure 4:
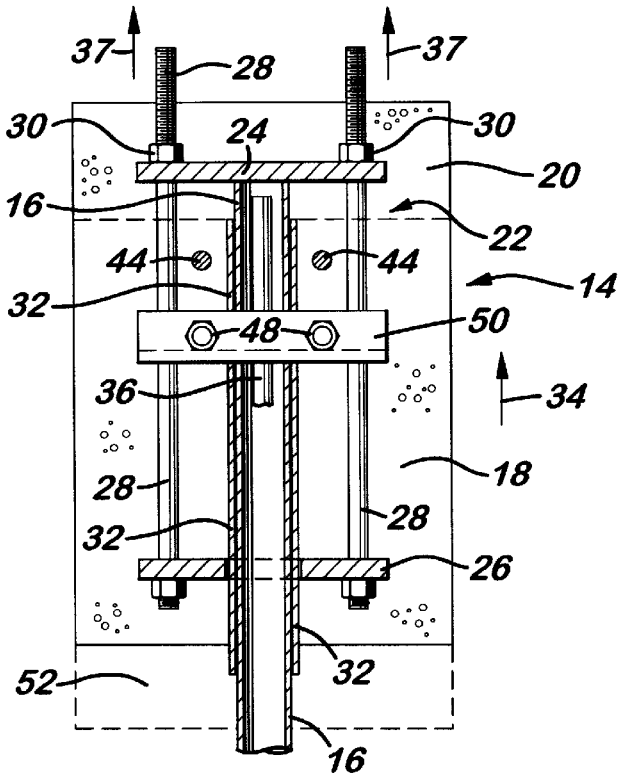
FIG. 4 is a front sectional view of the pierhead and jacking assembly with rebar and dowels used in securing the pierhead to a portion of the foundation.
Figure 5:
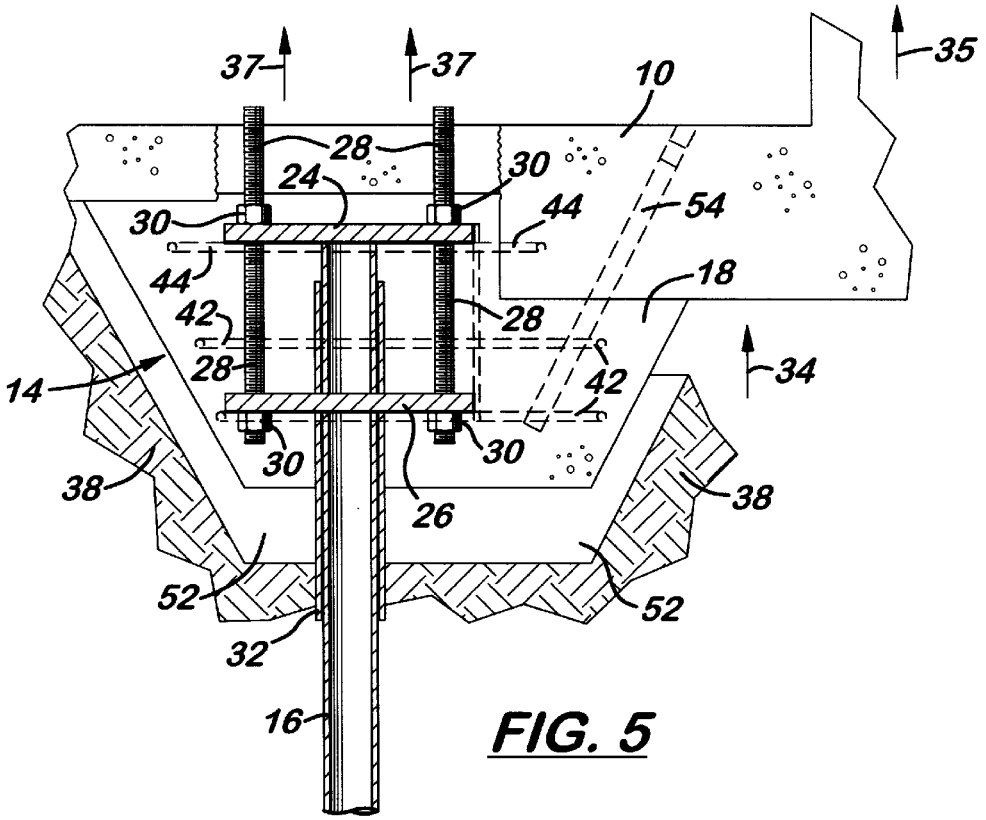
FIG. 5 is similar to FIG. 4 and is a side view of the pierhead and jacking assembly with rebar and dowels for securing the pierhead to the foundation and existing concrete floor slab. In this view, the jacking assembly has been used to raise the pierhead, foundation and floor slab to a selected grade.

To construct the pierhead 14 integral to the surrounding foundation and flooring system, reinforcing bars or rebar, dowels with epoxy and anchor bolts are used in combination with each other, mounted inside the pierhead 14 and attached to the foundation as shown in FIGS. 3–5.

It should be noted that when the pierhead 14 has been formed and cured, the pierhead 14 is raised, as indicated by arrows 34, by tightening threaded nuts 30 on the top jacking plate 24. Obviously, while not shown in the drawings, sufficient space is provided between the bottom of the top jacking plate 24 and the top of the pierhead 14 to raise the foundation 10, as indicated by arrows 35, and any attached flooring structures. When the leveling of the foundation 10 is complete by raising the pierhead 14 using the jacking assembly 22, the top of the all-thread bolts 28 are threaded upwardly, as indicated by arrows 37, as nuts 30 are tightened on the top jacking plate 24. At this time the top of bolts 28 can be cut off or left in place. The second pour 20 can then be poured to provide a cap over the pierhead 14 with the top of the second pour 20 corresponding with the level of any surrounding concrete slab floor structure thus providing a completed appearance.

Figure 2:
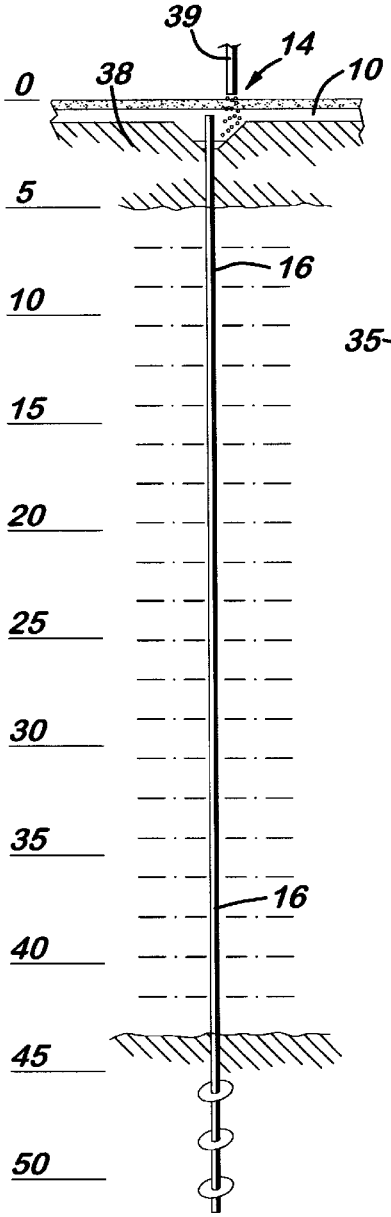
FIG. 2 is a side elevation view of the helix pipe pier is shown and installed to a depth of 50 feet in a ground surface. The concrete pierhead is attached to and grouted around the top of the pipe pier. The pierhead is attached to and integral to the interior of the foundation for leveling the structure.

In FIG. 2, a side elevation view of the helix pipe pier 16 is shown installed to a depth of 50 feet in a ground surface 38 with the concrete pierhead 14 attached to and grouted around the top of the pipe pier 16. The pierhead 14 is attached to and integral to the side of the foundation 10 for leveling the structure. A concrete deliver tube 39 is shown pouring grout or like high strength flowable material around a top portion of the pipe pier 16 for forming the pierhead 14.

As mentioned above, while the helix pipe pier 16 is shown in the drawings, it can be appreciated that various types of vertical support structures used in building construction can be used equally well for mounting the pierhead 14 thereon and without departing from the spirit and scope of the invention. Also, the pierheads described herein can be used as horizontally oriented brackets to tie pre-fabricated tunnel and bridge sections and other large structures. Further, while not shown in the drawings, the all-thread bolts 28 and the pipe pier 16 can be spring loaded when required to allow limited movement. This feature provides for improved shear resistance and reducing potential structural damage due to earthquake and seismic activity.

In FIG. 3, is a side sectional view of a portion of the of jacking assembly 22 is shown with the pierhead 14 cut away to illustrate the jacking assembly 22 connected to the foundation 10. Also, the concrete pierhead 14 and the top of the helix pipe pier 16 are shown after the foundation 10 and an existing concrete floor slab 40 have been raised, as indicated by arrow 35, and leveled to a selected grade. The concrete floor slab 40 is shown in FIG. 5. For added stability to the pierhead 14, a small grout tube 41 is shown connected to the top of the sleeve 32. The tube 41 is used, after the pierhead has been raised and the foundation and attached floor system have been leveled, for introducing grout under pressure into the sleeve 32 and around the inner circumference of the top portion of the pipe pier 16 and the reinforcing bar 36 inside the pipe pier.

In this drawing, the pierhead 14 is shown with rebar 42, dowels with epoxy or anchor bolts 44 with threaded ends 46 for receiving nuts 48. The threaded ends 46 are shown with an anchor plate 50 mounted thereon. The rebar 42 is shown in the form of a frame for adding strength to the pierhead 14 and a portion of the anchor bolts 44 drilled into the side of the foundation 10 for securing the pierhead 14 to the foundation 10. While the anchor bolts 44 are shown in the drawings, it should be kept in mind various types of securing devices can be used for integrating the pierhead 14 into the side of a foundation and flooring system and using the jacking assembly 22 raising it to grade.

In FIG. 4 illustrates a front sectional view of the jacking assembly 22 is shown and embedded inside a completed pierhead 14. In this view, the all-thread bolts 28 have been tightened on the top jacking plate 24 resting on top of the helix pipe pier 16, as indicated by arrows 37. The tightening of the nuts 30 on the bolts 28, next to the top jacking plate 24, raises the lower jacking plate 26 upwardly and in turn raises the pierhead 14 upwardly as indicated by arrow 34. In this drawing, a front view of the anchor plate 50 is shown with nuts 48 attached to a pair of anchor bolts 44 received in a side of the foundation 10.

In FIG. 5, another view of the completed pierhead 14 is shown with a portion of the concrete floor slab 40 having been cut away to form the pierhead next to a portion of the foundation 10. In this view, a void 52 has been formed in the ground surface 38 where the pierhead 14 has been raised on the helix pipe pier 16 for in turn lifting the foundation 10 and the concrete floor slab 40 to a level grade. Also shown in this drawing is a dowel 54 which has been received in a drill hole in a portion of the foundation 10 and the pierhead 14 and anchored thereto using epoxy or like bonding materials. As mentioned above, the rebar 42, anchor bolts 44 and dowels 54 can be used in combination for helping secure the pierhead 14 to the foundation and floor structure and making them integral to each other.

In operation and referring to FIGS. 1–5 in the drawings, the subject method as described above is used for forming a plurality of concrete foundation pierheads 14. Each pierhead 14 is attached to a side of the concrete foundation 10 and/or concrete floor slab 40 used with different types of structures. The pierheads 14 and jacking assembly 22 are used for leveling the foundation and the slab 40.

Each pierhead 14 includes a jacking assembly 22, which is used for jacking the pierhead 14 on top of the helix pipe pier 16 or similar support structure. The pier 16 or similar structure is driven into the ground surface 38 exterior to the foundation 10 or interior through a cut out hole in the concrete slab 40 next to the foundation as shown in FIG. 5.

When the method is used to form an interior pierhead, the steps include first coring the slab 40 using a core drill and jack hammering a portion of the grade beam edge 44 of the foundation 10, as shown in FIGS. 1 and 5, and then excavating a 2 foot deep hole. Then holes are drilled in the side of the foundation 10 for receiving threaded epoxy dowels 54. One of the dowels 54 is shown in FIG. 5.

The helix pipe pier 16 is then installed to a selected depth and to a selected torque requirement. An example of the installed pipe pier 16 is shown in FIG. 2. A top elevation of the pipe pier 16 is set to allow at least one more inch of slab rise than a floor level indicates. Then a plastic or metal sleeve 32, which is at least 8 inches in length and 5 inches in diameter, is disposed around the top of the pier 16 and set into the ground surface 38. The jacking plates 24 and 26 and the all-thread bolts 28 are then connected together and the rebar 42, anchor bolts 44, the anchor plate 50 and dowels 54 are set in place as shown in the drawings. It should be noted that by tightening the nuts 48 on the horizontal anchor bolts 44, the anchor plate 50 is pressed against the side of a portion of the top of the pipe pier 16 thereby placing the pier in tension to eliminate any undesirable movement when the pierhead 14 has been completed.

The first pour 18 of high strength concrete and like material, for example 4000 psi concrete, is poured with the top of the pierhead 14 placed 1 inch minimum below the expected lift of the slab 40 and foundation 10 with a minimum of 4 inches below the slab for nuts, bolt cut off and additional leveling if necessary. For example, if the slab 40 needs to be raised by 2 inches for leveling to grade using the pierhead 14 and jacking assembly 22, the clearance required would be 2 inches plus 1 inch minimum between the bottom of the top jacking plate 24 and the top of the newly formed pierhead 14. Also an additional 4 inches below the slab would be required for the nuts 30 and upper ends of the all-tread bolts 28.

When using the jacking assembly 22 under light loads, the nuts 30 can be hand tightened or an electric or pneumatic socket wrench used for tightening the nuts on the top jacking plate 24 which rests on top of the helix pipe pier 16 and the sleeve 32. When tightening the nuts 30, the all-tread bolts 28 are drawn upwardly, as indicated by arrows 37 in the drawings, which in turn draws the bottom jacking plate 26 upwardly with the sleeve 32 sliding upwardly around the outer circumference of the pipe pier 16. In this manner, the entire pierhead 14 is moved upwardly, as indicated by arrow 34 shown in the drawings.

When using the jacking assembly 22 under heavy loads, a hydraulic jack maybe used for loading against the top jacking plate 24. As pressure is applied to the top jacking plate, the pierhead or pierheads are raised upwardly to a selected grade and the foundation 10 and floor slab 40 are leveled. At this time, the nuts 30 are tightened on top of the top jacking plate 24, the hydraulic jack is removed and the top of the all-thread bolts 28 are cut off. The hydraulic jack is not shown in the drawings. The second concrete pour 20 is then poured on top of the pierhead 14 providing a pierhead cap and thus completing the installation.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The embodiments of the invention for which as exclusive privilege and property right is claimed are defined as follows:

1. A method for forming a concrete pierhead in a ground surface and raising the pierhead for leveling a foundation and/or flooring structure, the foundation and/or flooring structure integrally attached to the pierhead, the method steps comprising:

excavating a hole next to the foundation;

installing a support member in the hole and installing said support member at an angle from the horizontal to a selected depth in the ground surface;

installing a jacking assembly around a top portion of said support member and attaching said jacking assembly to the foundation, said jacking assembly including a top jacking plate, a bottom jacking plate and threaded bolts with nuts attaching said top jacking plate to said bottom jacking plate, said top jacking plate received on top of said support member, said jacking assembly also including a sleeve, said sleeve slipped around the top portion of said support structure;

pouring concrete around the jacking assembly and next to the foundation and/or flooring structure and allowing the concrete to cure and forming a concrete pierhead around the top portion of said support member and attached to the foundation; and jacking the pierhead upwardly by tightening nuts on said threaded bolts on the top of said top jacking plate and leveling the foundation and/or flooring structure to a level grade.

2. The method as described in claim 1 wherein said jacking assembly includes an anchor bolt with anchor plate, a portion of said anchor bolt attached to the foundation, said anchor plate engaging a side of the top portion of said support member, whereby when said anchor plate is tightened on said anchor bolt, said support member is moved toward the foundation and placed in tension.

3. The method as described in claim 1 wherein said jacking assembly includes a combination of an anchor bolt with anchor plate, reinforcing bars and dowels for attaching the pierhead to the foundation.

4. The method as described in claim 1 further including the step of adding a pierhead cap to the top of the completed pierhead after the foundation and/or flooring structure is raised t o a level grade.

5. A pierhead for leveling a foundation which is integrally attached thereto, the pierhead adapted for engaging a top portion of a support member, the pierhead comprising:

a jacking assembly having a top jacking plate, a bottom jacking plate and threaded nuts on threaded bolts attaching said top jacking plate to said bottom jacking plate, a portion of said top jacking plate adapted for receipt on the top of the support member; and a flowable material received around said jacking assembly and cured thereon;

whereby when said threaded nuts on said threaded bolts are tightened on said top jacking plate, said jacking assembly is raised on the support member for leveling the foundation.

6. The pierhead as described in claim 5 wherein said flowable material is a high strength concrete.

7. The pierhead as described in claim 5 further including a pierhead cap received on top of said cured flowable material.

8. The pierhead as described in claim 5 wherein said jacking assembly includes jacking assembly attachment means for securing said jacking assembly to the foundation.

9. The pierhead as described in claim 8 wherein said jacking assembly attachment means includes an anchor bolt with anchor plate, a portion of said or bolt attached to the foundation, said anchor plate adapted for engaging the portion of the support member, whereby when said anchor plate is tightened aid anchor bolt, the support member is placed in compression.

10. The pierhead as described in claim 8 wherein said jacking assembly attachment means includes a combination of an anchor bolt with anchor plate, reinforcing bars and dowels for attaching the pierhead to the foundation.

11. The pierhead as described in claim 5 wherein said jacking assembly includes a sleeve adapted for slidable receipt around the top portion of the support member.

12. The pierhead as described in claim 5 wherein the support member is a helix pipe pier, a top portion of said top jacking plate adapted for receipt on the top of the helix pipe pier.

13. A method for forming a concrete pierhead in a ground surface and raising the pierhead for leveling a foundation, which is integrally attached to the pierhead, the method steps comprising:

excavating a hole next to the foundation;

installing a support member in the hole and to a selected depth in the ground surface;

installing a jacking assembly, said jacking assembly including an top jacking plate, a bottom jacking plate and threaded bolts attaching said top jacking plate to said bottom jacking plate, a portion of said top jacking plate received on the top of said support member for jacking the pierhead thereon;

pouring concrete around said jacking assembly and next to the foundation, allowing the concrete to cure and forming the concrete pierhead around the top portion of said support member and attached to the foundation; and jacking the pierhead upwardly using said jacking assembly and in turn leveling the foundation to a level grade.

14. The method as described in claim 13 further including the step of adding a pierhead cap to the top of the completed pierhead after the foundation is raised to a level grade.

15. The method as described in claim 13 wherein said jacking assembly includes an anchor bolt with anchor plate, a portion of said anchor bolt attached to the foundation, said anchor plate engaging the top portion of said support member, whereby when said anchor plate is tightened on said anchor bolt, said support member is placed in compression.

16. The method as described in claim 13 wherein said jacking assembly includes a combination of an anchor bolt with anchor plate, reinforcing bars and dowels for attaching the pierhead to the foundation.

17. The method as described in claim 13 wherein said jacking assembly includes a sleeve adapted for receipt around the top portion of said support member.

* * * * *